US010508838B2

(12) United States Patent
Chen et al.

(10) Patent No.: US 10,508,838 B2
(45) Date of Patent: Dec. 17, 2019

(54) ULTRAHIGH-PERFORMANCE RADIATIVE COOLER

(71) Applicant: The Board of Trustees of the Leland Stanford Junior University, Palo Alto, CA (US)

(72) Inventors: Zhen Chen, Stanford, CA (US); Linxiao Zhu, Stanford, CA (US); Aaswath Raman, San Francisco, CA (US); Eli A. Goldstein, San Francisco, CA (US); Shanhui Fan, Stanford, CA (US)

(73) Assignee: The Board of Trustees of the Leland Stanford Junior University, Stanford, CA (US)

( * ) Notice: Subject to any disclaimer, the term of this patent is extended or adjusted under 35 U.S.C. 154(b) by 150 days.

(21) Appl. No.: 15/651,595

(22) Filed: Jul. 17, 2017

(65) Prior Publication Data

US 2018/0023866 A1 Jan. 25, 2018

Related U.S. Application Data

(60) Provisional application No. 62/364,099, filed on Jul. 19, 2016.

(51) Int. Cl.
*F25B 23/00* (2006.01)

(52) U.S. Cl.
CPC ..... *F25B 23/003* (2013.01)

(58) Field of Classification Search
CPC ..... F25B 23/00; F25B 23/003
USPC ..... 165/110
See application file for complete search history.

(56) References Cited

U.S. PATENT DOCUMENTS 3,043,112 A * 7/1962 Head ..... F25B 23/003 62/56
3,310,102 A * 3/1967 Trombe ..... F24F 5/0089 165/133
4,423,605 A * 1/1984 Petrick ..... F25B 23/003 126/569
4,624,113 A * 11/1986 Hull ..... F25B 23/003 62/235.1

* cited by examiner

*Primary Examiner* — Steve S Tanenbaum
(74) *Attorney, Agent, or Firm* — Lumen Patent Firm

(57) ABSTRACT

A radiative cooler is provided having a thermally insulated vacuum chamber housing that is configured to support a vacuum level of at least $10^{-5}$ Torr, an infared-transparent window that is sealably disposed on top of the thermally insulated vacuum chamber and is transparet in the range of 8-13 μm, a selective emitter disposed inside the chamber, a mirror cone on the infared-transparent window, a selective emitter inside the chamber and is configured to passively dissipate heat from the earth into outer space through the infared-transparent window and is thermally decoupled from ambient air and solar irradiation but coupled to outer space, a heat exchanger with inlet and outlet pipes disposed below the selective emitter to cool water flowing through the pipe, a sun shade disposed vertically outside the chamber to minimize direct solar irradiation, and a mirror cone to minimize downward atmospheric radiation.

6 Claims, 8 Drawing Sheets

Angle of incidence
0 °
30 °
60 °
87.5 °
Dewpoint
-10 °C
0 °C
10 °C
20 °C

Transmittance
1
0.8
0.6
0.4
0.2
0
5
8 10 13
20
25
Wavelength [μm]

ULTRAHIGH-PERFORMANCE RADIATIVE COOLER

CROSS-REFERENCE TO RELATED APPLICATIONS

This application claims priority from U.S. Provisional Patent Application 62/364,099 filed Jul. 19, 2016, which is incorporated herein by reference.

FIELD OF THE INVENTION

The current invention relates generally to heat energy conversion. More particularly, the invention relates to a high-efficiency radiative cooling device.

BACKGROUND OF THE INVENTION

From fundamental thermodynamics considerations, high efficiency conversion from heat to work requires both a high temperature heat source and a low temperature heat sink. The vast majority of energy conversion processes at present use the ambient surrounding here on Earth as the heat sink. On the other hand, outer space, at a temperature of 3 K, provides a much colder heat sink. Moreover, Earth's atmosphere has a transparency window in the wavelength range from 8 to 13 μm that coincides with the peak of the blackbody spectrum of typical terrestrial temperatures around 300K, enabling the process of radiative cooling, i.e. radiative ejection of heat from Earth to outer space, and hence the direct radiative access to this colder heat sink. Exploitation of radiative cooling therefore has the potential to drastically improve a wide range of energy conversion and utilization processes on Earth.

The study of radiative cooling has a long history. It has been well known since ancient times, that a black radiator facing a clear night sky can reach sub-ambient temperature. More recently, daytime radiative cooling under direct sunlight was demonstrated, where one used a specially designed radiator that reflects most of the sunlight but radiates efficiently in the atmospheric transparency window. However, the demonstrated performance thus far has been rather limited. For nighttime cooling, in typical populous areas the demonstrated temperature reduction from ambient air is on the order of 15-20° C. A temperature reduction of up to 40° C. has been demonstrated only at high-altitude desert locations with extremely low humidity. For daytime cooling, the demonstrated temperature reduction is approximately 5° C. An important open question then is: what is the fundamental limit of temperature reduction that can be achieved in typical populous areas on Earth?

Radiative cooling technology has been foreseen by Department of Energy as a strong candidate to complement existing cooling technology, e.g. air conditioning. Due to its passive nature, radiative cooling technology does not consume electrical power, nor does it emit greenhouse gases. However, the performance achieved thus far is rather limited, which hinders the wide application of radiative cooling.

What is needed is a radiative cooler that demonstrates a temperature reduction that far exceeds what is known in the art.

SUMMARY OF THE INVENTION

To address the needs in the art, radiative cooler is provided, where according to one embodiment the radiative cooler includes a thermally insulated vacuum chamber housing that is configured to support a vacuum level of at least $10^{-5}$ Torr, an infared-transparent window that is sealably disposed on top of the thermally insulated vacuum chamber, where the infared-transparent window has a transparency in the range of 8-13 μm, a selective emitter disposed inside the thermally insulated vacuum chamber housing, a mirror cone that includes an open bottom disposed on the infared-transparent window and surrounds the infared-transparent window, where the mirror cone is configured to reduce downward atmospheric radiation bombarding on the infared-transparent window, a selective emitter disposed proximal to the infared-transparent window inside the thermally insulated vacuum chamber housing, where the selective emitter is configured to passively dissipate heat from the earth into outer space through the infared-transparent window, where the selective emitter is thermally decoupled from ambient air and solar irradiation but coupled to outer space, where each radiation shield includes holes for receiving the ceramic support pegs, where the radiation shields are disposed in a stack on the ceramic support pegs, where each of the radiation shields are separated by ceramic washers, where the radiation shields are disposed below the selective emitter inside the thermally insulated vacuum chamber housing, and a sun shade disposed vertically outside the thermally insulated chamber housing and the mirror cone, where the sun shade is configured to minimize direct solar irradiation.

In one aspect of the current embodiment, the infared-transparent window includes a ZnSe window.

In another aspect of the current embodiment, the infared-transparent window includes a double-side antireflection coating.

According to a further aspect of the current embodiment, the selective emitter includes layers of silicon nitride ($Si_3N_4$), silicon (Si), and aluminum (Al) disposed on a substrate.

In yet another aspect of the current embodiment, the selective emitter includes a backside reflection coating.

According to a further embodiment of the invention, a radiative cooler is provided that includes a thermally insulated housing having hollow walls configured to support a vacuum level of at least $10^{-5}$ Torr, an infared-transparent window that is sealably disposed on top of the thermally insulated housing, where the infared-transparent window has a transparency in the range of 8-13 μm, a mirror cone that includes an open bottom disposed on the infared-transparent window and surrounds the infared-transparent window, where the mirror cone is configured to reduce downward atmospheric radiation bombarding on the infared-transparent window, a selective emitter, where a top side of the selective emitter is disposed proximal to the infared-transparent window inside the thermally insulated housing, where the a selective emitter is configured to passively dissipate heat from the earth into outer space through the infared-transparent window and is thermally decoupled from ambient air and solar irradiation but coupled to outer space, where the ceramic support pegs are disposed on an inner bottom surface of the thermally insulated housing and configured to support the selective emitter, and a sun shade disposed vertically outside the thermally insulated housing and the mirror cone, where the sun shade is configured to minimize direct solar irradiation.

In one aspect of the current embodiment, the infared-transparent window includes a polyethylene thin film.

According to a further aspect of the current embodiment, the selective emitter includes layers of silicon nitride ($Si_3N_4$), silicon (Si), and aluminum (Al) disposed on a substrate.

In yet another aspect of the current embodiment, the selective emitter includes a backside reflection coating.

According to a further embodiment, the radiative cooler includes a thermally insulated housing includes hollow walls, where the hollow walls are configured to support a vacuum level of at least $10^{-5}$ Torr, an infared-transparent window that is sealably disposed on top of the thermally insulated housing, where the infared-transparent window has a transparency in the range of 8-13 μm, a mirror cone that includes an open bottom disposed on the infared-transparent window and surrounds the infared-transparent window, where the minor cone is configured to reduce downward atmospheric radiation bombarding on the infared-transparent window, a selective emitter, where a top side of the selective emitter is disposed proximal to the infared-transparent window inside the thermally insulated housing, where the a selective emitter is configured to passively dissipate heat from the earth into outer space through the infared-transparent window, where the selective emitter is thermally decoupled from ambient air and solar irradiation but coupled to outer space, a plate heat exchanger that is in contact with a bottom side of the selective emitter, where the plate heat exchanger includes a cooling inlet pipe and a cooling outlet pipe configured to cool a fluid that passes into the inlet pipe and out of the outlet pipe, and a sun shade, where the sun shade is disposed vertically outside the thermally insulated housing and the mirror cone, where the sun shade is configured to minimize direct solar irradiation.

In one aspect of the current embodiment, the infared-transparent window includes a polyethylene thin film.

According to a further aspect of the current embodiment, the selective emitter includes layers of silicon nitride ($Si_3N_4$), silicon (Si), and aluminum (Al) disposed on a substrate.

In yet another aspect of the current embodiment, the selective emitter includes a backside reflection coating.

DETAILED DESCRIPTION

Radiative cooling technology utilizes the atmospheric transparency window (8-13 μm) to passively dissipate heat from the earth into outer space (3K). This technology has attracted broad interests from both fundamental sciences and real world applications. However, the temperature reduction experimentally demonstrated thus far has been relatively modest. The current invention provides ultra large temperature reduction for as much as 60° C. from ambient, and demonstrates a temperature reduction that far exceeds previous works. In a populous area at sea level, the invention has achieved an average temperature reduction of 37° C. from the ambient air temperature through a 24 hour day-night cycle, with a maximal reduction of 42° C. that occurs at peak solar irradiance. This invention demonstrates a significant fundamental potential for radiative cooling, which may have practical impacts ranging from passive building cooling, renewable energy harvesting, and passive refrigeration in arid regions.

Figure 1A:
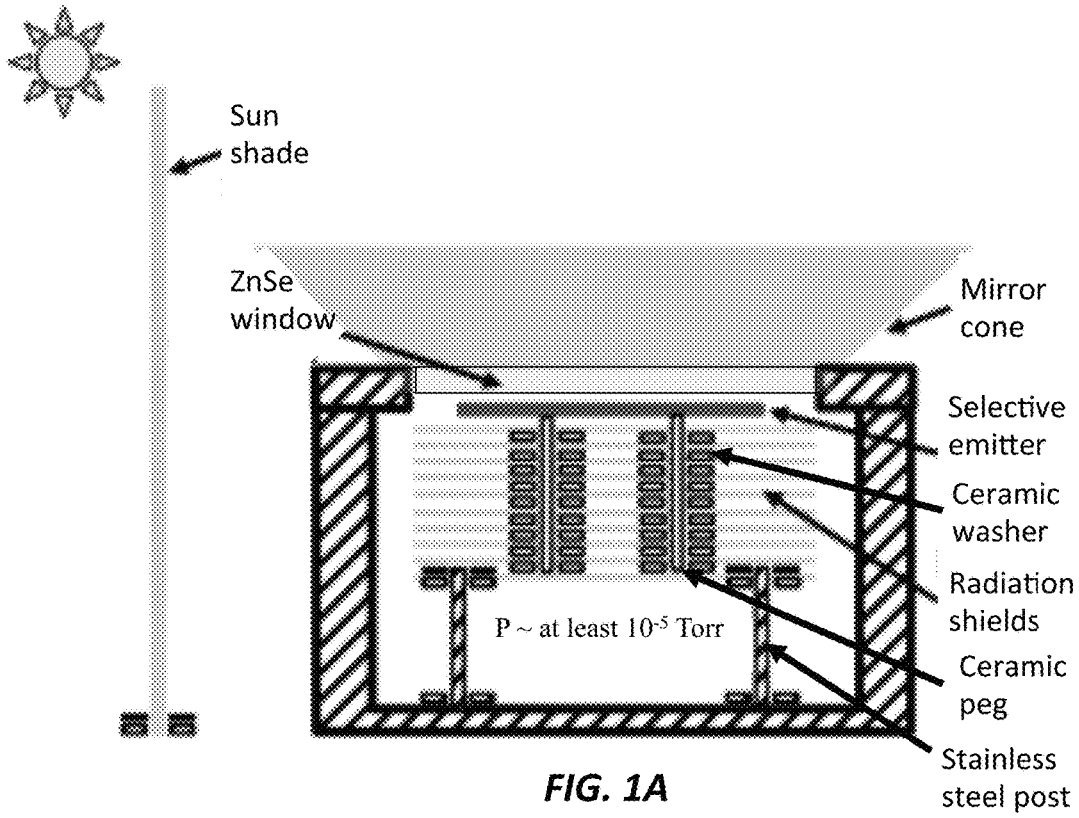
FIGS. 1A-1C show schematic drawings embodiments of the current invention, where the key feature is to minimize parasitic heat losses of convection and air conduction using a vacuum system, where (1A) shows radiation shields and long hollow ceramic pegs provided to further reduce the radiation and conduction losses through the backside of the selective emitter, a shinny sun shade is shown to minimize direct solar irradiation, and a mirror cone is shown to minimize downward atmospheric radiation, where ZnSe is selected for its transparency in the mid-infrared wavelength range, (1B) shows ceramic posts supporting the selective emitter, (1C) shows a heat exchanger with fluid I/O ports cooling fluid flowing through the pipe, according to embodiments of the invention.
Figure 1B:
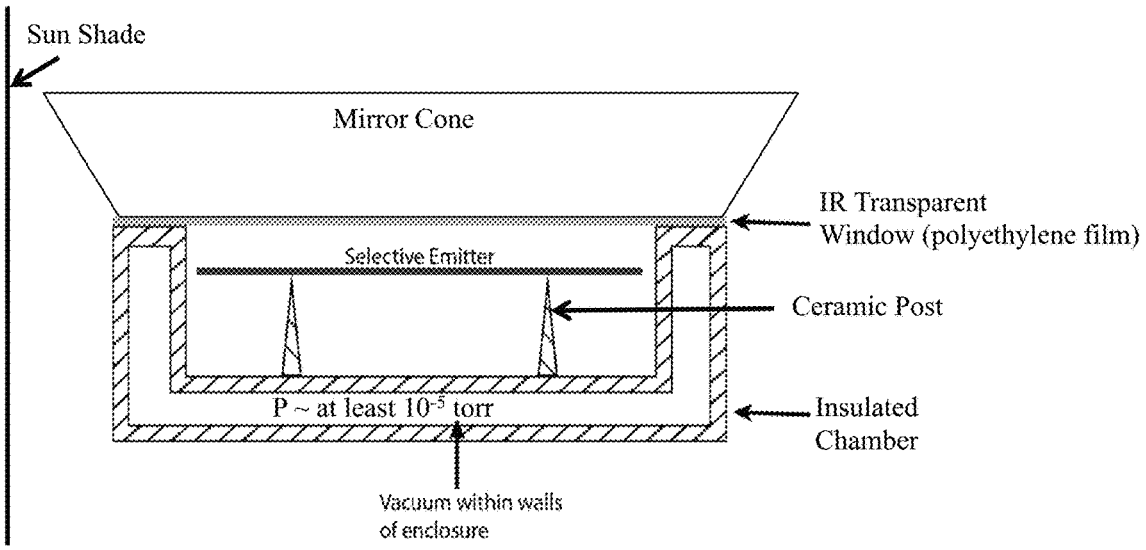
Figure 1C:
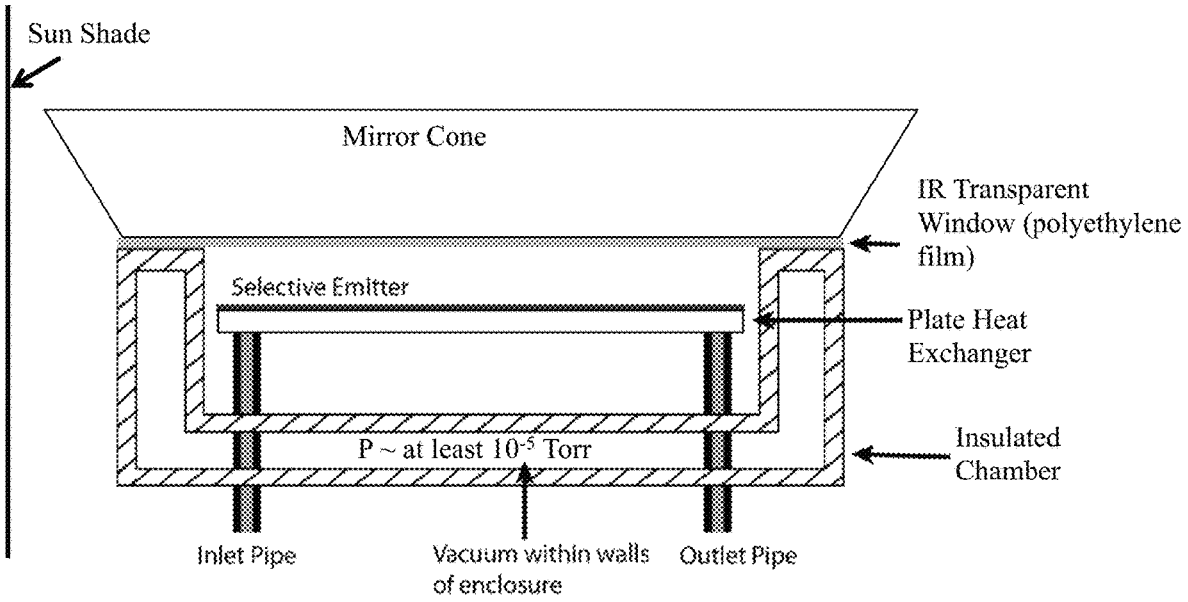

The disclosure of the current invention first theoretically shows that ultra large temperature reductions up to 60° C. below ambient can be achieved. The key to such ultra large temperature reduction is to use highly selective thermal emitter matched to the atmospheric transparency window, and to minimize parasitic heat losses. Experimentally, the invention is demonstrated by the cooling apparatus (FIGS. 1A-1B), which exhibit continuous passive cooling throughout both day and night. In a 24 hour day-night cycle, the cooler is maintained at a temperature that is at least 33° C. below ambient air temperature, with a maximal temperature reduction of 42° C., which occurs during peak solar irradiance. FIGS. 1A-1B show schematic drawings embodiments of the current invention, where the key feature is to minimize parasitic heat losses of convection and air conduction using a vacuum system, where FIG. 1A shows radiation shields and long hollow ceramic pegs provided to further reduce the radiation and conduction losses through the backside of the selective emitter, a shinny sun shade is shown to minimize direct solar irradiation, and a mirror cone is shown to minimize downward atmospheric radiaiton, where ZnSe is selected for its transparency in the mid-infrared wavelength range. FIG. 1B shows ceramic posts supporting the selective emitter. FIG. 1C shows a heat exchanger with fluid input and output ports to cool fluid flowing through the pipe, according to embodiments of the invention.

To illustrate the pathway towards achieving ultra-large temperature reduction, the ideal case first needs to be considered, where the atmosphere is 100% transparent at a particular wavelength range. In such a case, an emitter that has unity emissivity within this wavelength range, and zero emissivity outside, will reach the temperature of outer space of 3K in the absence of parasitic heat loss, since in such a case the emitter is undergoing thermal exchange only with outer space.

Figure 2A:
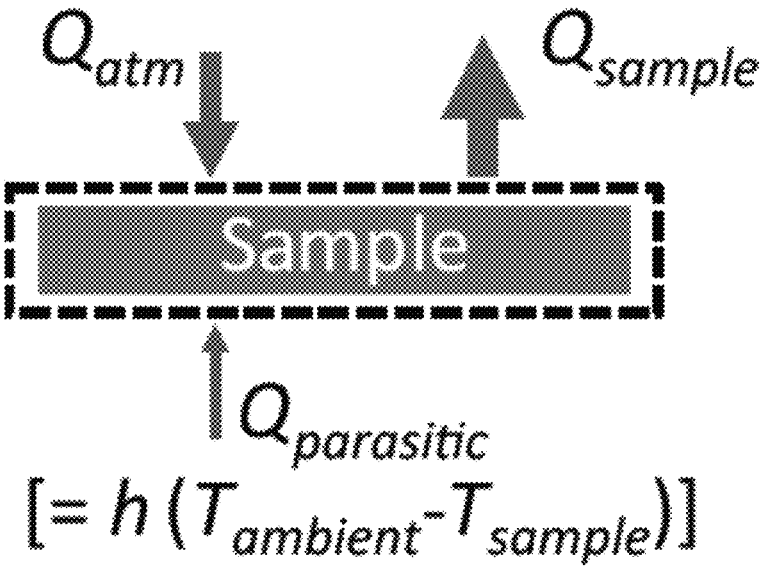
FIGS. 2A-2C show (2A) Energy balance applied to the radiative emitter (dashed line), where the net flux ($Q_{net}$) is determined by the outgoing flux from the emission of the sample ($Q_{sample}$), and the two incoming fluxes from the emission of the atmosphere ($Q_{atm}$) and the parasitic heat losses ($Q_{parasitic}$) characterized by a heat transfer coefficient h. (2B) shows two emitters are considered: a black emitter and a near-ideal selective emitter which has unit emissivity inside the atmospheric transparency window (8-13 μm) and zero emissivity outside the atmospheric window, and (2C) a net flux ($Q_{net}$) as a function of the temperature of the sample ($T_{sample}$), where the key parameter is the steady state temperature corresponding to $Q_{net}=0$, and the analysis highlights the two key ingredients to achieve high performance radiative cooling: selectivity of the emitter and minimization of the parasitic heat loss, according to one embodiment of the invention.
Figure 2B:
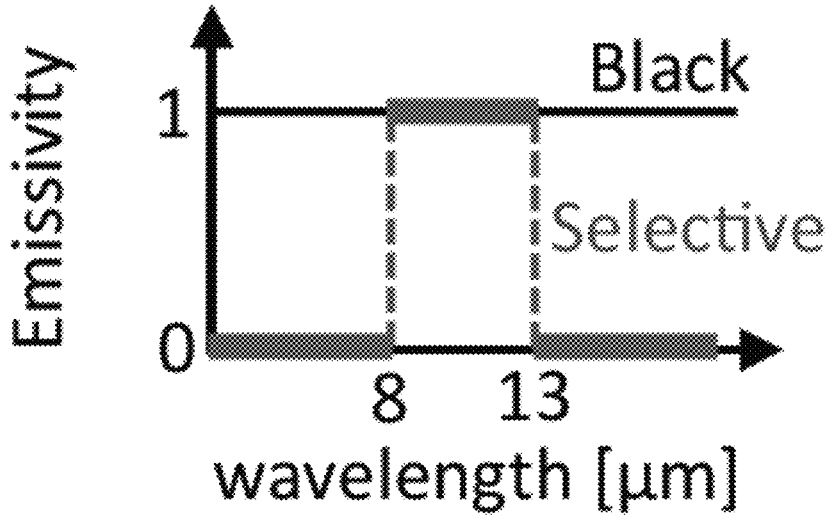
Figure 2C:
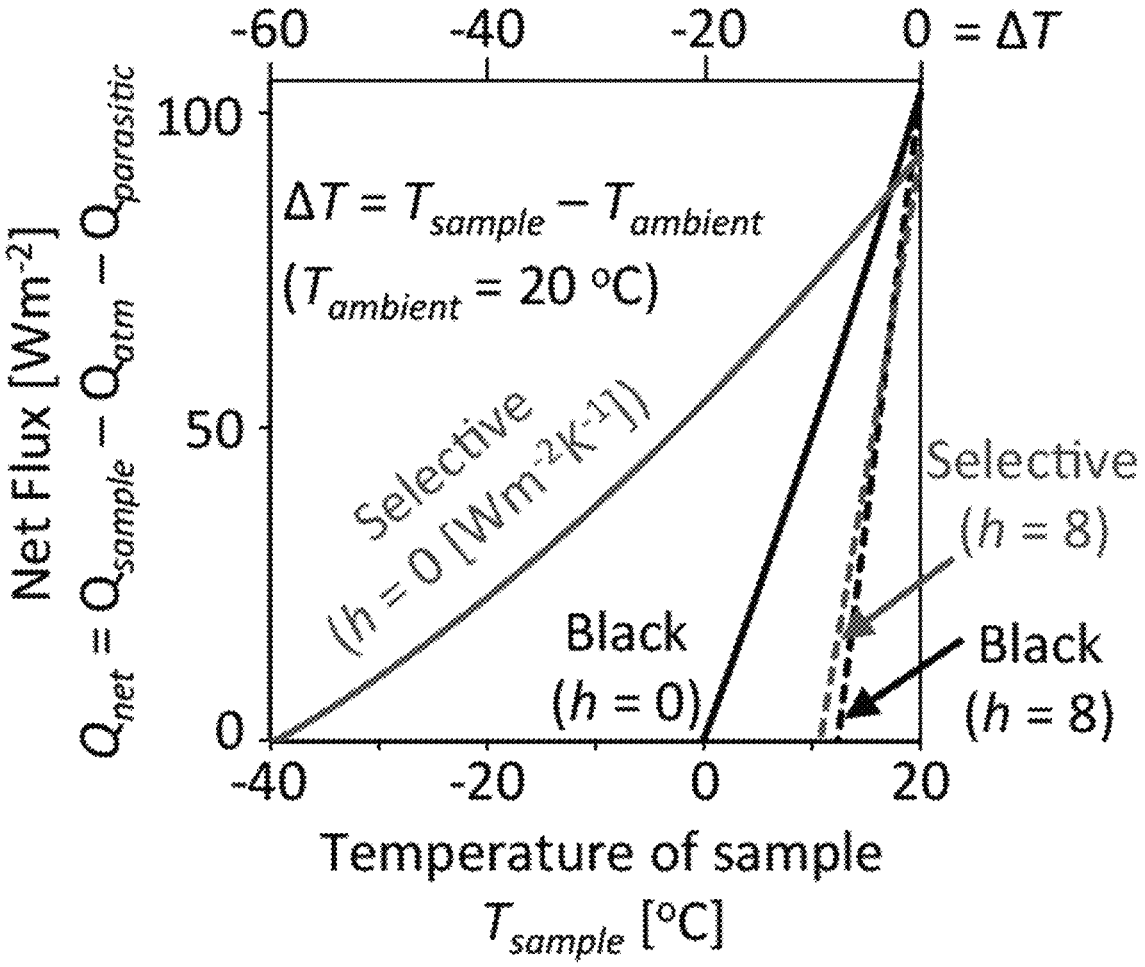

For a more realistic case, the theoretical analysis as illustrated in FIGS. 2A-2C was performed, where the transmittance of the atmosphere is taken to be typical of Stanford, Calif. Here for simplicity the performance of nighttime cooling was analyzed. The performance of nighttime cooling provides the upper bound for the performance during daytime, an upper bound that can be reached by completely suppressing solar radiation on the cooler.

The steady-state temperature (FIG. 2A) of a radiative emitter is determined by the energy balance among three key components: the emitted thermal radiation from the sample ($Q_{sample}$), the absorbed thermal radiation from the atmosphere ($Q_{atm}$), and the parasitic heat losses ($Q_{parasitic}$) characterized by a heat transfer coefficient h. Two different emitters are considered (FIG. 2B): a black emitter and a near-ideal selective emitter that has unit emissivity inside the atmospheric transparency window (8-13 μm) and zero emissivity outside. In FIG. 2C, the net flux is plotted, $$Q_{net}=Q_{sample}-Q_{atm}-Q_{parasitic}, \quad (1)$$

as a function of the temperature of the sample, $T_{sample}$. The steady state temperature of the sample is reached when the net flux ($Q_{net}$) reaches zero. Here the ambient temperature ($T_{ambient}$) is fixed to be 20° C., and a typical atmospheric transmittance is used corresponding to local conditions as shown in FIG. 3B. For each emitter, two parasitic heat transfer coefficients are considered: h=8 $Wm^{-2}K^{-1}$ represents a typical experimental setup without sophisticated thermal design, while h=0 $Wm^{-2}K^{-1}$ represents an ideal case with perfect thermal insulation.

FIG. 2C underlines two key features. First, with a substantial parasitic heat loss (h=8 $Wm^{-2}K^{-1}$), the difference in performance between the black and the selective emitter is relatively small. Both the black emitter and the near-ideal selective emitter are restricted to a temperature reduction $|\Delta T|$~10° C. Second, when the parasitic heat loss is completely eliminated (h=0 $Wm^{-2}K^{-1}$), there is a very large difference in terms of performance between the black and the selective emitter. Whereas the temperature reduction of the black emitter is limited to $|\Delta T|$~20° C., the selective emitter achieves a far higher temperature reduction $|\Delta T|$~60° C. Thus, in order to approach the fundamental limit on radiative cooling, both selective emitter and ultralow parasitic heat loss are essential. These considerations, together with the need to suppress solar absorption during the daytime, motivate the design of the experimental apparatus and the selective emitter.

An example embodiment of the invention is provided that includes a selective emitter surrounded by a vacuum chamber, which is shielded from direct sunlight (FIG. 1A). The key here is to ensure that the selective emitter is thermally decoupled from the ambient air and the sun, but coupled to outer space through the atmospheric transparency window. The apparatus therefore has the following features. First, the parasitic heat losses through air conduction and convection are minimized with the use of a vacuum chamber (~$10^{-6}$ Torr). The losses through thermal radiation and heat conduction from the backside of the selective emitter can also be reduced by various approaches. Here, ten concentric reflective radiation shields and four long-hollow ceramic pegs are provided as an example. Second, the vacuum chamber is equipped with a ZnSe window with double-side antireflection coating. Such a window has high transmittance in the wavelength range of the atmospheric transparency window, which ensures radiative access from the selective emitter to outer space. Third, the direct and indirect solar irradiation onto the emitter is minimized by a combination of a shade that is placed vertically at the side of the chamber, and a mirror cone that surrounds the ZnSe window on the chamber.

FIG. 1B can be seen as an alternative configuration of FIG. 1A, for the selective emitter to reach an ultra low temperature. FIG. 1C can be seen as an example of application to utilize the cold temperature of the selective emitter to generate cold water: room temperature water flowing through the inlet pipe can be cooled after flowing out of the outlet pipe. The key distinction here is that in FIG. 1A the selective emitter sits in vacuum, while in FIGS. 1B-1C the selective emitter sits in the atmosphere. Note that In FIGS. 1B-1C, the side and bottom walls are pulled to vacuum. Correspondingly, a rigid ZnSe window is needed to hold vacuum for the configuration in FIG. 1A, but just a soft and flexible polyethylene thin film is required for the embodiments of FIGS. 1B-1C, where both the ZnSe window and the polyethylene thin film are transparent in the 8-13 μm wavelength range.

The temperature of the selective emitter and the ambient air is measured by K-type thermocouples. Two thermocouples are anchored with conductive cement on the backside of the selective emitter: one at the center, and the other at the edge to check the temperature uniformity. The measured non-uniformity (<0.3K) is well within the resolution of the thermocouple.

Figure 3A:
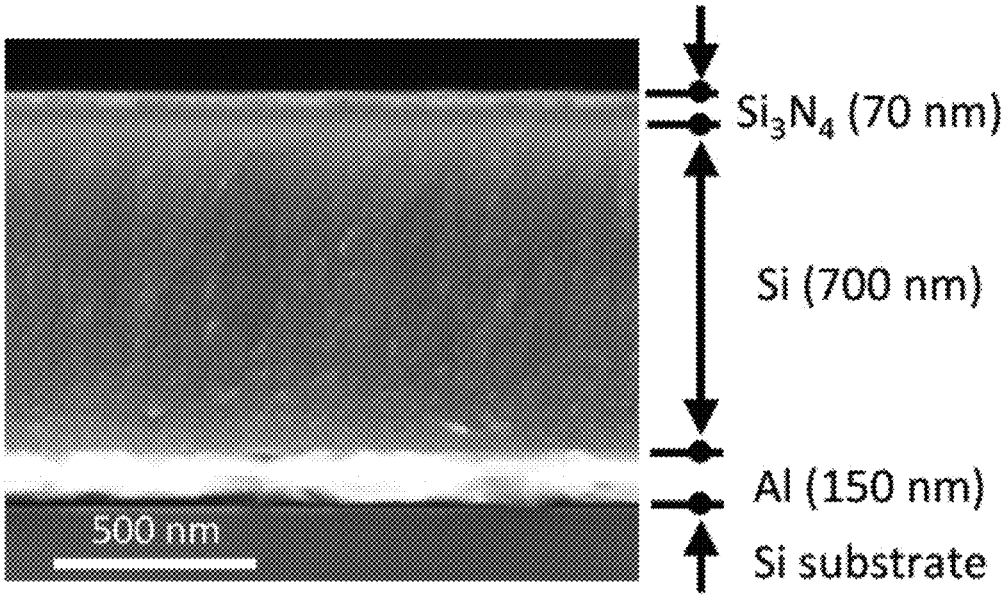
FIGS. 3A-3B show structure and spectrum of the selective emitter, (3A) cross-sectional SEM image, (3B) spectral emissivity of the selective emitter, measured using FTIR and averaged over both polarizations, aligns very well with the atmospheric transmittance, the ZnSe window also confirmed to be transparent throughout the atmospheric transparency window, where for clarity, here only show results along normal direction, according to one embodiment of the invention.
Figure 3B:
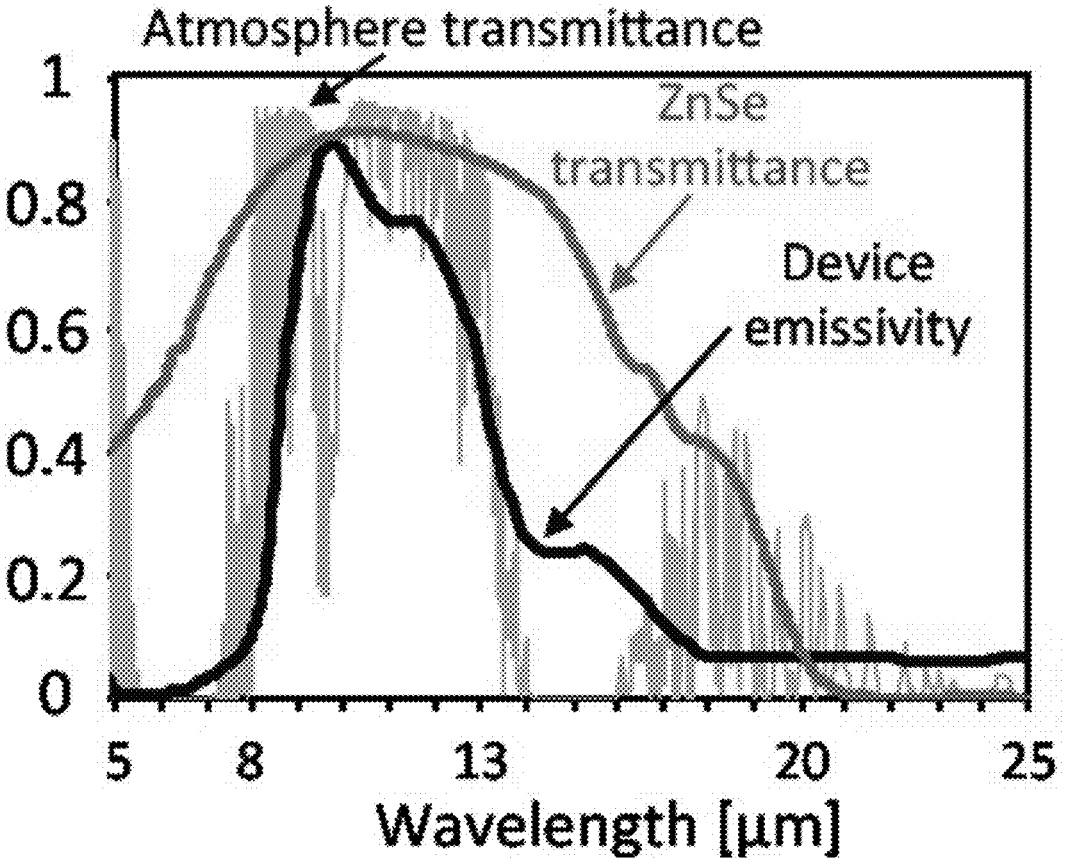

FIG. 3A shows a cross sectional scanning electron microscope (SEM) image of the emitter designed to approach the near-ideal emitter spectrum as shown in FIG. 2B. It includes layers of silicon nitride ($Si_3N_4$), silicon (Si), and aluminum (Al), with thickness of 70 nm, 700 nm, and 150 nm, respectively, on top of a Si wafer underneath that provides mechanical support. Here the emission arises primarily from the phonon polariton excitation in $Si_3N_4$. Moreover, the thickness of $Si_3N_4$ is chosen to be sufficiently small in order to substantially reduce unwanted radiative loss at wavelengths outside the atmospheric transparency window.

The emissivity spectrum of the structure is shown in FIG. 3B, together with the transmission spectrum of the ZnSe window of the vacuum chamber, and a typical local atmospheric transmittance. Both the emissivity of the emitter and the transmission of the ZnSe window are characterized using Fourier transform infrared spectroscopy (FTIR) and averaged over both polarizations. FTIR characterizations were performed on the selective emitter over the full hemispherical solid angles, but for clarity data along the normal direction are only shown here. The emissivity exhibits a broad plateau that matches well with the atmospheric transparency window. Within this plateau the ZnSe window is also largely transparent. Therefore, the design here ensures that the selective emitter can exchange heat effectively with outer space through the ZnSe window and the atmosphere. In the meantime the emitter has little emissivity outside the transparency window, which minimizes the heating effect of the downward radiation from the atmosphere.

Measurements were performed by exposing the experimental apparatus to a clear sky throughout a 24-hour day-night cycle at Stanford, Calif. A typical measurement (FIG. 4A) shows the temperature of the selective emitter, the ambient air, as well as their difference. The solar irradiance (right axis) of a typical clear day in winter is also measured for reference. A few prominent features can be clearly recognized from FIG. 4A. First, the temperature of the selective emitter rapidly decreases to be ~40° C. below ambient air within half hour after the vacuum chamber is pumped down to ~$10^{-5}$ Torr. Second, it tracks closely the trend of the temperature of the ambient air in the following 24 hours, with an average temperature reduction from the ambient of 37.4° C. Finally, the maximal temperature reduction from ambient (42.2° C.) appears around the peak of the solar irradiance. This seemingly counter-intuitive observation points to the effectiveness of the sun shade/mirror cone for blocking sunlight, and arises from the high contrast between the ambient air temperature and the dew point when the solar irradiance reaches its peak.

Figure 4A:
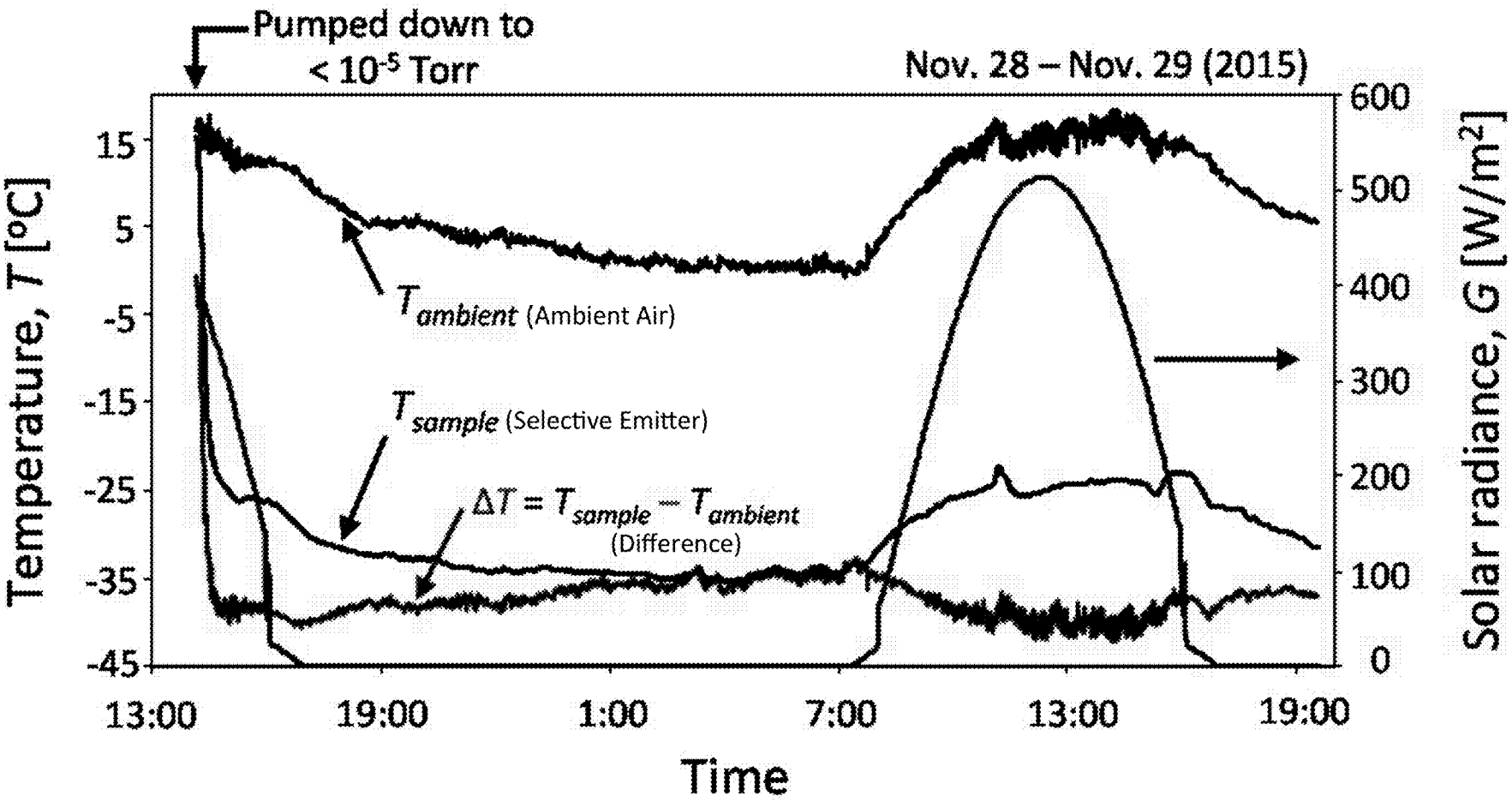
FIGS. 4A-4C show experimental results (4A) ultrahigh performance radiative cooling in a 24 hour day-night cycle, where after pumping down to at least $10^{-5}$ Torr, the selective emitter rapidly cools down to ~40° C. below ambient temperature within half hour, and where maximal cooling of 42.2° C. synchronizes the peak of the solar radiance, confirming the function of the sun shade and the mirror cone (FIGS. 1A-1B), and also highlighting the high contrast between the ambient temperature and the dew point during this period, (4B) a comparison with theoretical models: temperature reduction, ΔT, as a function of dew point, with the ambient temperature fixed at $T_{ambient}=16\pm1°$ C., and (4C) ΔT as a function of ambient temperature, with the dew point fixed at $T_{dew\text{-}point}=3\pm1°$ C., where the shaded areas represent the uncertainties of the model resulting from the uncertainties in estimating the parasitic heat losses of our thermal design, and the results in 4B and 4C underline a guideline to achieve high performance radiative cooling: selective emitter with low dew point and high ambient temperature, according to one embodiment of the invention.
Figure 4B:
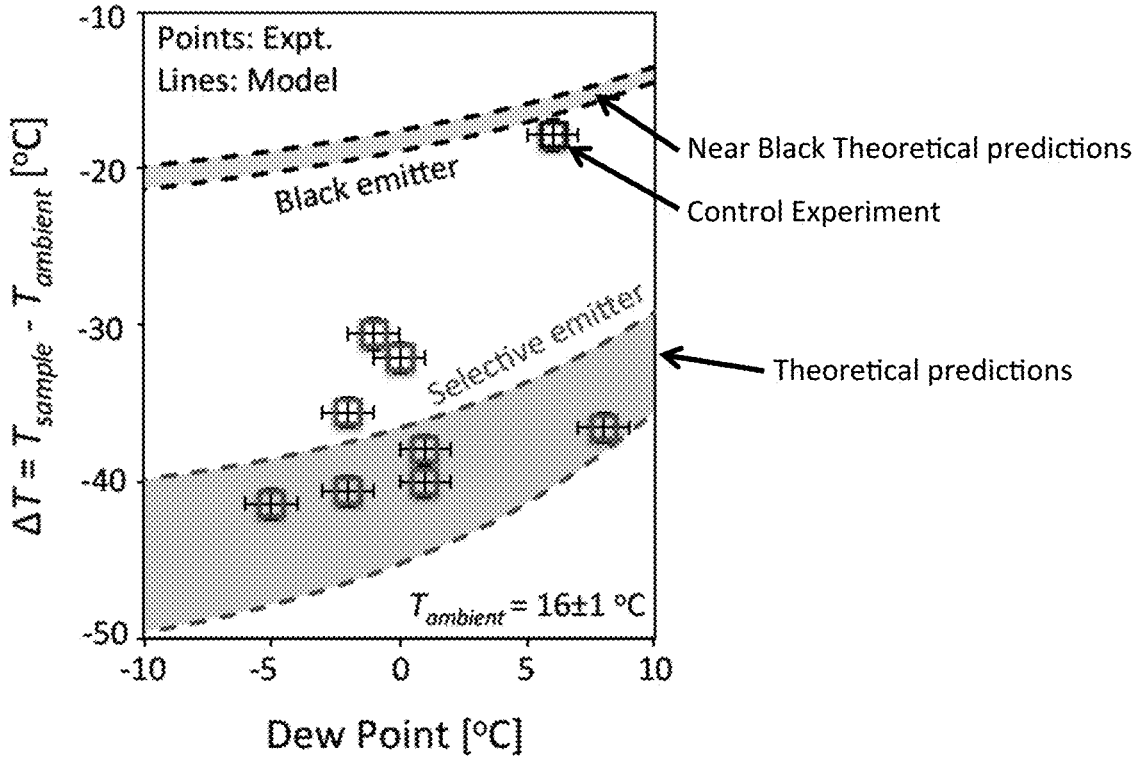
Figure 4C:
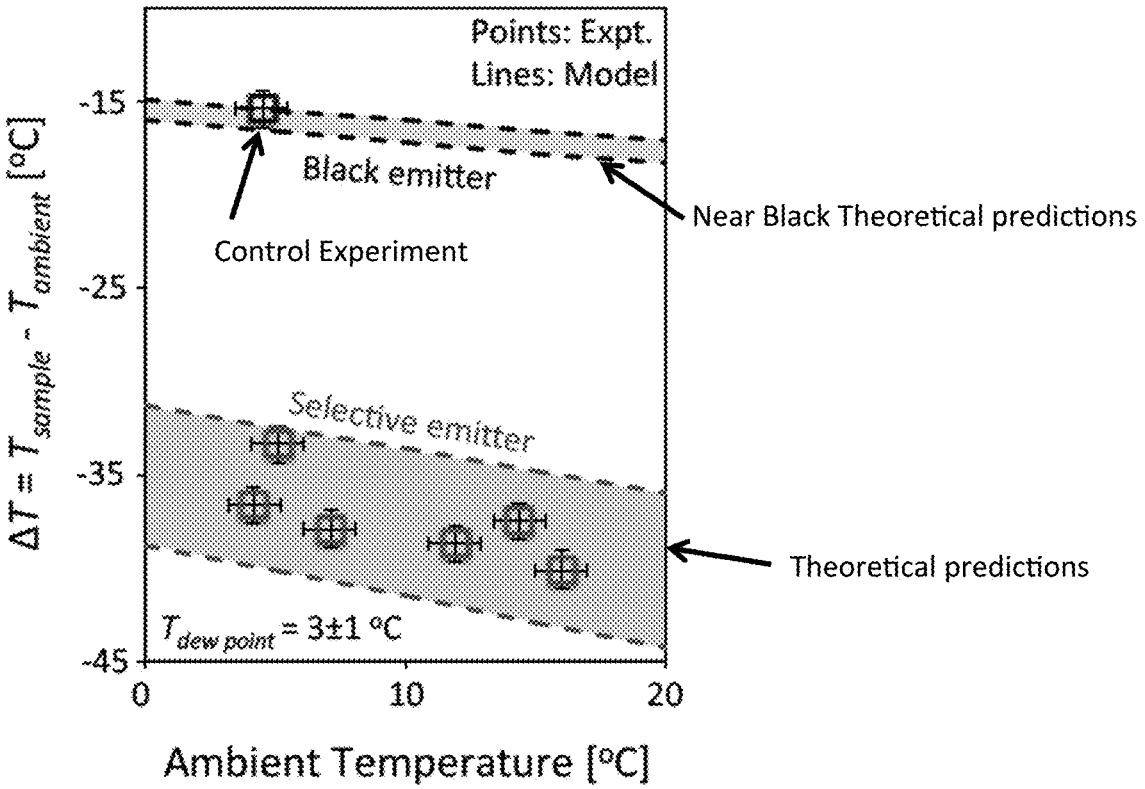

FIGS. 4B-4C compare the experimental results of the selective emitter to the theoretical predictions. A control experiment (black points) is also performed on a near-black emitter having a 50 μm fused silica slide coated on its backside with 150 nm of aluminum film. The theoretical predictions for such a near black emitter is shown. In the theoretical prediction, the performance of either device is bound under maximal and minimal parasitic heat loss, estimated for our thermal design. In FIGS. 4B-4C the temperature reduction is considered as a function of dew point (ambient air temperature), while keeping the ambient air temperature (dew point) fixed. In general, the experiment agrees well with the theory, the few outliers in FIG. 4B may suggest that the atmospheric downward radiation, in some circumstances, may depend on more parameters in addition to the dew point and the ambient air temperature. In both FIGS. 4B-4C, the performance of the selective emitter is far better as compared to the near-black emitter. Also, for the same range of variation in parasitic heat loss, the variation in performance for the selective emitter is far greater compared with that of the near-black emitter. Thus the selective emitter is more sensitive in its performance to the variation of parasitic heat loss, confirming the prediction shown in FIG. 2C.

FIG. 4B shows that for a fixed ambient air temperature the cooling performance improves as the dew point decreases. A low dew point results in a more transparent atmospheric window, and thus a better radiative cooling performance. FIG. 4C shows that for a fixed dew point, the temperature reduction increases as the ambient temperature increases. Examining the energy balance of the emitter (Eq. 1), it is seen that the ambient temperature enters through both the downward atmospheric radiation ($Q_{atm}$) and the parasitic heat loss ($Q_{parasitic}$). On the other hand, the use of the selective emitter and the vacuum chamber significantly reduces these two terms, and as a result the equilibrium temperature of the sample becomes less dependent on the ambient air temperature. Thus the temperature reduction tends to increase as the ambient temperature increases. Indeed, the peak performance is obtained when the ambient air temperature is high and the dew point is low. In FIG. 4A this occurs near the point of peak solar irradiance.

In summary, the experiments here provide a record-setting performance in radiative cooling during both day and night. The demonstrated steady-state temperature is far below the freezing point even during peak sunlight. The invention demonstrates the possibility of reaching the fundamental limit of radiative cooling by combining photonic and thermal design. From a practical point of view, radiative cooling is becoming important in a number of areas including passive building cooling, renewable energy harvesting from the universe[21], and refrigeration in arid region. This invention points to an avenue for further improvement of radiative cooling systems. The selective emitter provided here relies on thin film deposition that can be performed at large scales. The vacuum system can also be implemented on a large industrial scale. For example, the evacuated solar water collectors had been installed over a total area of 106 million $m^2$ worldwide by 2007. These collectors use vacuum that is at a similar level as in this disclosure. One variation can include cooling objects by flowing coolant underneath the selective emitter through feedthroughs of the vacuum system.

Thermal design of the experimental apparatus minimizing parasitic heat losses is essential to achieving the record performance of radiative cooling, as indicated in FIGS. 2A-2C. The experimental apparatus shown in FIGS. 1A-1B are configured to suppress losses through all the three heat transfer modes: conduction, convection, and radiation.

Experiments inside high vacuum (as low as ~$10^{-6}$ Torr) were conducted to eliminate convection, and in particular to reduce air conduction. The key here is to truncate the mean free path of air molecules, thus reducing its thermal conductivity. The resulting heat loss through air conduction is estimated to be less than 0.1% of the downward atmospheric radiation absorbed by the selective emitter.

To reduce any radiative loss through the backside of the selective emitter, the bottom surface of the selective emitter is coated with 150-nm-thick aluminum thin film, for example by using e-beam evaporation. In the embodiment shown in FIG. 1A, ten concentric radiation shields are placed between the vacuum chamber floor and the selective emitter. These radiation shields are made of polished aluminum sheets with minor-like surfaces.

To minimize the conductive loss, four hollow ceramic pegs are disposed to support the selective emitter above the radiation shields, as shown in the embodiment of FIG. 1A, and another four stainless steel threads to support the whole system above the vacuum chamber floor, and the thermal contact is further weakened between the ceramic pegs and the uppermost/lowermost radiation shields. The ten radiation shields are separated from each other by ceramic washers that are concentric with the ceramic pegs. In the exemplary embodiment, each ceramic peg has length of 0.91", and outer/inner diameter of 0.156" and 0.094", respectively.

With this thermal design, the parasitic heat transfer coefficient is estimated (see FIG. 2A), h, to be in the range of 0.1–0.3 $Wm^{-2}K^{-1}$, which bounds the shaded areas in FIGS. 4B and 4C. The time constant of this exemplary apparatus is estimated to be ~10 min, which is consistent with the transient behavior in FIG. 4A.

Turning now to the fabrication and characterization of the selective emitter, the exemplary selective emitter is fabricated in Stanford Nanofabrication Facility (SNF) and Stanford Nano Shared Facilities (SNSF). The process starts with a 380-μm-thick, 100 mm diameter, double-side-polished crystalline silicon wafer. During a single session of electron beam evaporation, a 150 nm thick layer of aluminum, and a 700 nm thick layer of silicon, are successively evaporated on one side of the silicon wafer. A 70 nm thick layer of silicon nitride ($Si_3N_4$) is then deposited on the top by using high-density plasma chemical vapor deposition (HDPCVD). To suppress the radiative heat loss through the backside of the selective emitter, a 150 nm thick layer of aluminum is evaporated on the other side of the silicon wafer using electron beam evaporation. The selective emitter is cleaved to fit in the vacuum chamber.

A scanning electron microscope (FEI NovaSEM 450) is used to image the selective emitter, as shown in FIG. 3A. A Fourier transform infrared (FTIR) spectrometer (Nicolet 6700, Thermo Fisher Scientific) is used to characterize the reflectance of the selective emitter with a gold film used as a reflectance standard. A variable-angle reflection accessary (Seagull, Harrick Scientific) equipped with KRS-5 substrate based wire grid polarizer (Seagull FTIR polarizer, Harrick Scientific) allows for reflectance measurements at varying angles of incidence for both polarizations.

Figure 5A:
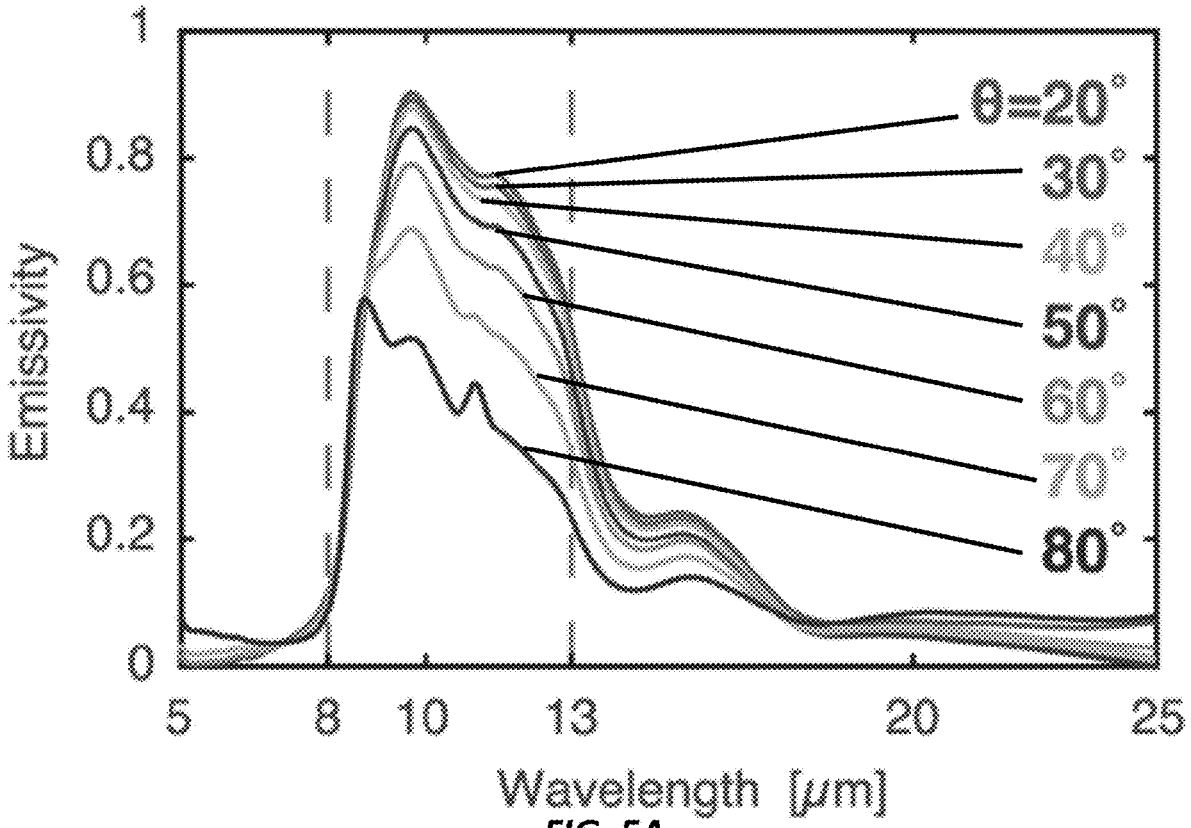
FIGS. 5A-5B show (5A) the measured spectral angular emissivity of the selective emitter, where the measured emissivity of the selective emitter at varying angles of incidence from 20° to 80°, with an interval of 10°, averaged over both polarizations (see 5B), where the average measured emissivity of the selective emitter between 8 and 13 μm, and average measured emissivity of the selective emitter outside the 8-13 μm atmospheric transparency window, plotted as a function of polar angle of incidence, according to one embodiment of the invention.
Figure 5B:
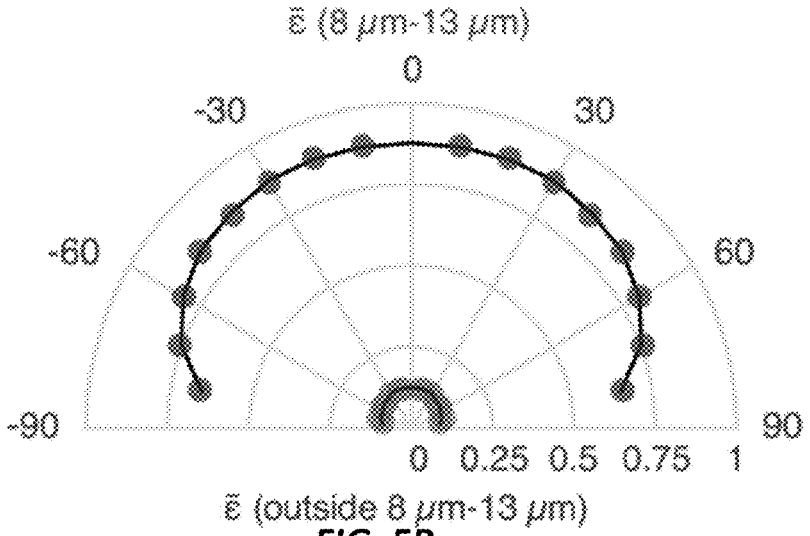

The measured spectral angular emissivity of the selective emitter is shown in FIG. 5A-5B. Here, it was observed that the emitter exhibits strong selectivity. At 0° C., the hemispherically-weighed emissivity of the emitter in the atmospheric window (8-13 μm) is 0.632, while that outside the atmospheric window is only 0.086. Such a strong selective emissivity is essential to achieving a substaintial low temperature below the ambient air temperature. In addition, the large emissivity inside the atmospheric window enables a high cooling power.

Further shown in FIGS. 5A-5B is that the emissivity of the emitter gradually decreases towards oblique angles. This is desirable for achieving ultrahigh-performance radiative cooling, as the atmosphere is increasingly opaque at larger angles of incidence (see FIGS. 6A-6P).

Turning now to the ZnSe window, in one example, the vacuum chamber is equipped with a 4.4-inch-diameter ZnSe window (0.32-inch thick) from Laser Research Optics, as shown in FIG. 1A. The ZnSe window is double-side coated with anti-reflection layers, to enhance transmission at wavelengths centered at 10.6 μm. The transmittance and reflectance of the ZnSe window are measured using Fourier transform infrared spectrometer (FTIR), as shown in FIGS. 2A-2C. Note here in this example, the FTIR is only capable to accurately measure the normal angle because of the large diameter, especially the large thickness of the ZnSe window. Several other angles that are smaller than 45° were roughly measured, and it was found that the deviation in transmittance is within 3% from that of the normal angle. Therefore, in the theoretical model below the results of normal angle were used to represent the optical properties of the ZnSe window.

Regarding the heat transfer model, consider a selective emitter at temperature T, with spectral angular emissivity $\varepsilon(\lambda, \Omega)$. When the selective emitter is exposed to a clear sky, it is subject to thermal radiation from the atmosphere (corresponding to ambient air temperature $T_{ambient}$). The steady state temperature T of the selective emitter is determined by $$Q_{sample}(T)-Q_{atm}(T_{ambient})-Q_{parasitic}=0 \tag{2}$$

In Eq. (2), the emitted power from the selective emitter is $$Q_{sample}(T)=\int d\Omega \cos\theta \int_0^\infty d\lambda I_{BB}(T,\lambda)\varepsilon(\lambda,\Omega). \tag{3}$$

Here $\int d\Omega=\int_0^{\pi/2}d\theta \sin\theta \int_0^{2\pi}d\varphi$ is an integral over the hemispherical solid angle. $I_{BB}(T,\lambda)=(4\pi hc^2/\lambda^5)/[e^{2\pi hc/(\lambda k_B T)}-1]$ is the intensity of a blackbody at temperature T, where h is the reduced Planck constant, c is the velocity of light, $k_B$ is the Boltzmann constant, and $\lambda$ is wavelength.

The absorbed power from atmosphere is $$Q_{atm}(T_{ambient})=\int d\Omega \cos\theta \int_0^\infty d\lambda I_{BB},\lambda)\varepsilon(\lambda,\Omega)\varepsilon_{atm}(\lambda,\Omega). \tag{4}$$

Here, $\varepsilon_{atm}(\lambda, \Omega)$ is the spectral angular emittance of the atmosphere. Kirchhoff's law was used to replace absorptivity of the selective emitter with its emissivity $\varepsilon(\lambda, \Omega)$.

The parasitic heat loss is $$Q_{parasitic}=h(T_{ambient}-T), \tag{5}$$

which uses an effective heat transfer coefficient, h, to take into account of conduction through the ceramic pegs and radiation from the back side of the selective emitter. Recall from the thermal design, h is estimated in the range of 0.2-0.4 $Wm^{-2}K^{-1}$, which bounds the shaded bands in FIG. 4B and FIG. 4C.

For improved accuracy, this model also takes into account of the ZnSe window, which has a spectral transmittance $t_w(\lambda)$, reflectance $r_w(\lambda)$ and absorptance $\alpha_w(\lambda)$. Here, by energy conservation we have $t_w(\lambda)+r_w(\lambda)+\alpha_w(\lambda)=1$. It is assumed that the ZnSe window is at the ambient air temperature $T_{ambient}$. This is justified since the window is thermally very well coupled to the ambient air and the vacuum chamber.

After considering the effect of the ZnSe window, the emitted power from the selective emitter in Eq. (3) is modified to be $$Q_{sample}(T) = \int d\Omega\cos\theta \int_0^\infty d\lambda I_{BB}(T, \lambda)\varepsilon(\lambda, \Omega)\frac{t_w(\lambda) + \alpha_w(\lambda)}{1 + r_w[\varepsilon(\lambda, \Omega) - 1]}. \tag{6}$$

Likewise, the absorbed power is modified to be $$Q_{atm}(T_{ambient}) = \int d\Omega \cos\theta \int_0^{\infty} d\lambda I_{BB}(T_{ambient}, \lambda)\varepsilon(\lambda, \Omega)\varepsilon_{atm}(\lambda, \Omega)\frac{\varepsilon_{atm}t_w(\lambda) + \alpha_w(\lambda)}{1 + r_w[\varepsilon(\lambda, \Omega) - 1]}, \quad (7)$$

which now includes contributions from both the atmosphere and the ZnSe window.

The spectral angular transmittance $t_{atm}(\lambda, \Omega)$ of the atmosphere is obtained using a standard commercial software (ModTran5), at different wavelengths and incident angles. As the transparency of the atmosphere strongly depends on the amount of water vapor, also obtained is the $t_{atm}(\lambda, \Omega)$ for varying dew point temperatures. The spectral angular emittance of the atmosphere is $\varepsilon_{atm}(\lambda, \Omega)=1-t_{atm}(\lambda, \Omega)$ .

Figures 6A, 6B, 6C, 6D, 6E, 6F, 6G, 6H, 6I, 6J, 6K, 6L, 6M, 6N, 6O, 6P:
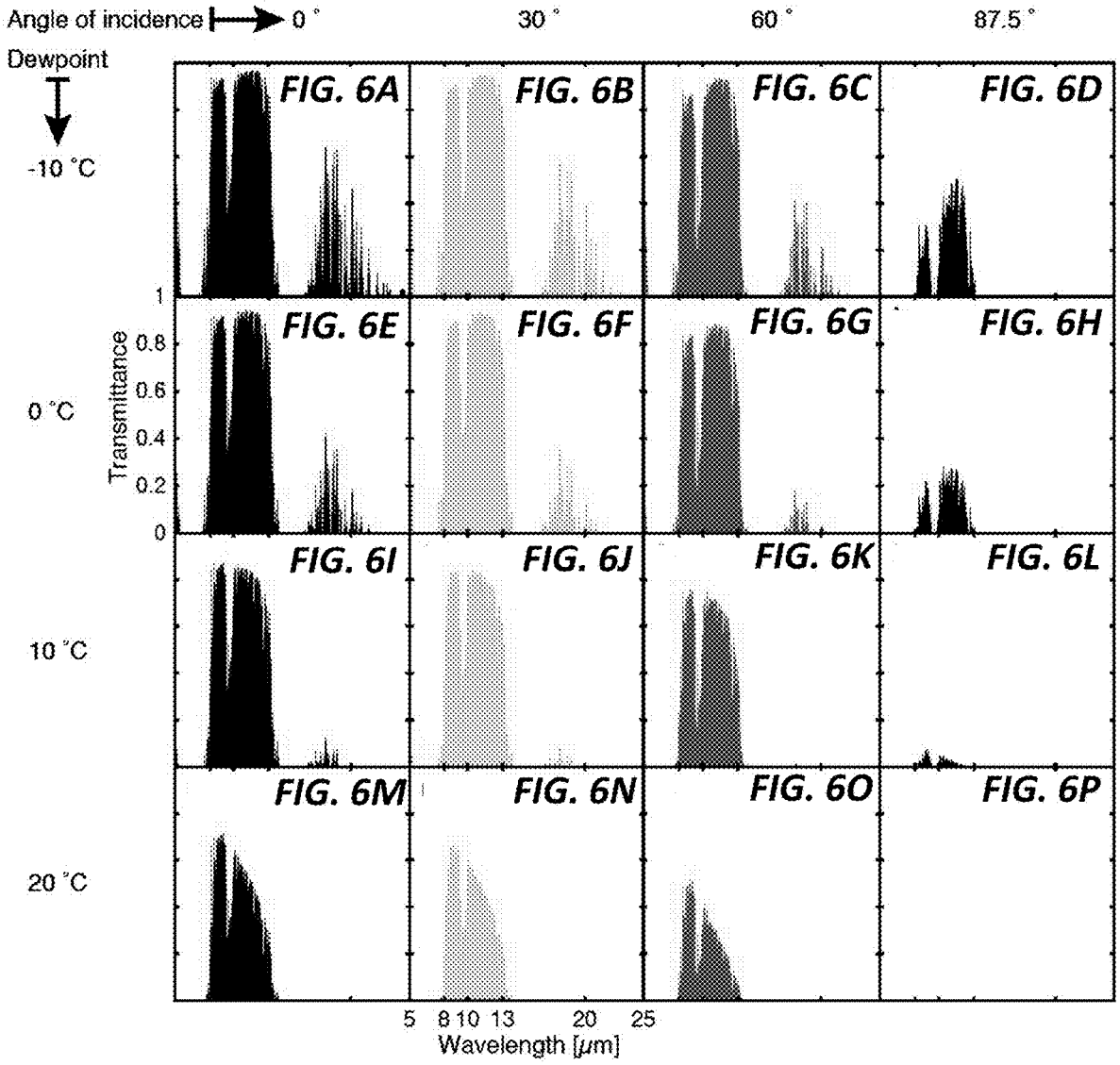
FIGS. 6A-6P show the atmospheric transmittance, at varying angles of incidence and dew point temperatures, where the atmospheric transmittance are obtained using ModTran5 for mid-latitude regions in winter, where the atmospheric transmittance spectra are shown at 0°, 30°, 60° and 87.5° angle of incidence (see 6A-6D), the atmospheric transmittance at −10° C. dew point temperature (see 6E-6H), the atmospheric transmittance at 0° C. dew point temperature (see 6I-6L), the atmospheric transmittance at 10° C. dew point temperature (see 6M-6P), according to the current invention.

The atmospheric transmittance for varying dew point temperatures and incident angles is shown in FIGS. 6A-6P. It was observed that the atmosphere has a major mid-infrared transparency window between 8-13 μm. As the dew point temperature increases, the transparency of the atmosphere decreases. For a given dew point temperature, as incident angle increases, the transparency of the atmosphere also decreases, as a result of the longer optical path at larger incident angle. Recall from FIGS. 5A-5B that the emissivity of the selective emitter also decreases as the incident angle increases, which is a desirable feature to achieve the new record of radiative cooling.

The present invention has now been described in accordance with several exemplary embodiments, which are intended to be illustrative in all aspects, rather than restrictive. Thus, the present invention is capable of many variations in detailed implementation, which may be derived from the description contained herein by a person of ordinary skill in the art. All such variations are considered to be within the scope and spirit of the present invention as defined by the following claims and their legal equivalents.

What is claimed:

1. A radiative cooler comprising a mirror cone disposed on top of a thermally insulated vacuum chamber, wherein said mirror cone comprises an open top and an open bottom, wherein said thermally insulated vacuum chamber comprises an infrared-transparent window sealably disposed on top of said thermally insulated vacuum chamber, wherein said mirror cone is disposed on said infrared-transparent window, wherein said infrared-transparent window has a transparency in the range of 8-13 μm, wherein an interior of said thermally insulated vacuum chamber comprises:

a) at least one stainless steel post;

b) a stack of radiation shield sheets;

c) ceramic washers;

d) at least one ceramic peg; and e) a selective emitter;

wherein said at least one stainless steel post supports said stack of radiation shield sheets above a bottom surface of said thermally insulated vacuum chamber, wherein said radiation shield sheets are separated by said ceramic washers in an alternating sequence of said radiation shield sheets and said ceramic washers, wherein said ceramic washers are disposed circumferentially to said at least one ceramic peg, wherein said selective emitter is disposed on top of said at least one ceramic peg, wherein said selective emitter is disposed below and separated from said infrared-transparent window, wherein said selective emitter is thermally decoupled from ambient air and sunshine.

2. The radiative cooler according to claim 1, wherein said infrared-transparent window comprises a ZnSe window.

3. The radiative cooler according to claim 1, wherein said infrared-transparent window comprises a double-side anti-reflection coating.

4. The radiative cooler according to claim 1, wherein said selective emitter comprises layers of silicon nitride ($Si_3N_4$), silicon (Si), and aluminum (Al) disposed on a substrate.

5. The radiative cooler according to claim 1, wherein said selective emitter comprises a backside reflection coating.

6. The radiative cooler according to claim 1, further comprising a sun shade, wherein said sun shade is disposed vertically outside said thermally insulated vacuum chamber and said mirror cone, wherein said sun shade is configured to minimize direct solar irradiation.

* * * * *